US010119355B2

(12) United States Patent
Rogozinski et al.

(10) Patent No.: US 10,119,355 B2
(45) Date of Patent: Nov. 6, 2018

(54) RELEASING A WELL DROP

(71) Applicant: Halliburton Energy Services, Inc., Houston, TX (US)

(72) Inventors: Nicolas Rogozinski, Duncan, OK (US); Henry Rogers, Oklahoma City, OK (US); Michael Malave, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 158 days.

(21) Appl. No.: 15/108,379

(22) PCT Filed: Jan. 6, 2014

(86) PCT No.: PCT/US2014/010354
§ 371 (c)(1),
(2) Date: Jun. 27, 2016

(87) PCT Pub. No.: WO2015/102646
PCT Pub. Date: Jul. 9, 2015

(65) Prior Publication Data
US 2016/0326827 A1 Nov. 10, 2016

(51) Int. Cl.
*E21B 33/068* (2006.01)
*E21B 23/04* (2006.01)

(52) U.S. Cl.
CPC ..... *E21B 33/068* (2013.01); *E21B 23/04* (2013.01)

(58) Field of Classification Search
CPC . Y10T 137/4891; E21B 33/068; E21B 33/05; F16L 55/46
See application file for complete search history.

(56) References Cited

U.S. PATENT DOCUMENTS 3,146,477 A * 9/1964 Bergman ..... F16L 55/46 137/268
3,971,436 A * 7/1976 Lee ..... E21B 33/05 166/155
5,758,726 A 6/1998 Streich et al.
5,960,881 A * 10/1999 Allamon ..... E21B 21/103 166/285
6,244,560 B1 * 6/2001 Johnson ..... E21B 33/062 251/1.3
6,302,199 B1 * 10/2001 Hawkins ..... E21B 33/05 137/268
6,715,541 B2 4/2004 Pedersen et al.
(Continued)

FOREIGN PATENT DOCUMENTS

EP 1132565 A2 9/2001
WO 0107748 A2 2/2001

OTHER PUBLICATIONS

PCT International Search Report and Written Opinion of the International Searching Authority, PCT/US2014/010354, dated Oct. 10, 2014, 12 pages.

*Primary Examiner* — Kipp C Wallace
(74) *Attorney, Agent, or Firm* — John Wustenberg; Parker Justiss, P.C.

(57) ABSTRACT

A well drop releasing device has a housing attachable to a well tubing. The device has a well drop carrier to carry a well drop. The well drop carrier is linearly movable to move the well drop from an exterior the well tubing into an interior the well tubing and release the well drop in the interior of the well tubing.

20 Claims, 2 Drawing Sheets

(56) References Cited

U.S. PATENT DOCUMENTS

| | | | | |
|---|---|---|---|---|
| 6,776,228 | B2 | 8/2004 | Pedersen et al. | |
| 6,969,042 | B2 * | 11/2005 | Gaydos | E21B 33/062 251/1.1 |
| 7,624,810 | B2 | 12/2009 | Fould et al. | |
| 7,735,548 | B2 * | 6/2010 | Cherewyk | E21B 43/26 15/104.062 |
| 8,136,585 | B2 * | 3/2012 | Cherewyk | E21B 33/068 137/268 |
| 8,869,882 | B2 * | 10/2014 | McGuire | E21B 33/068 137/268 |
| 9,752,405 | B1 * | 9/2017 | Jennings | E21B 33/063 |
| 2003/0155115 | A1 | 8/2003 | Pedersen et al. | |
| 2008/0053660 | A1 * | 3/2008 | Angman | E21B 19/06 166/373 |
| 2008/0223587 | A1 | 9/2008 | Cherewyk | |
| 2013/0062055 | A1 | 3/2013 | Tolman et al. | |
| 2013/0228326 | A1 * | 9/2013 | Griffith | E21B 33/068 166/75.15 |
| 2015/0021024 | A1 * | 1/2015 | Artherholt | E21B 33/05 166/281 |

* cited by examiner

RELEASING A WELL DROP

CROSS-REFERENCE TO RELATED APPLICATIONS

This application is a U.S. National Phase Application under 35 U.S.C. § 371 and claims the benefit of priority to International Application Serial No. PCT/US2014/010354, filed on Jan. 6, 2014, the contents of which are hereby incorporated by reference.

BACKGROUND

The concepts herein relate to releasing a well drop into an interior of a well tubing.

There are a number of instances in drilling, completing and producing from a subterranean well where an object is purposefully dropped into the well to plug a downhole opening or apply an impact load. The object, i.e., a well drop, can take many forms, but is typically a spherical ball. Plugging the opening seals the opening against flow and allows the operator to apply fluid pressure to actuate a tool or isolate one portion of the well from another. For example, in certain instances of cementing a casing into a wellbore, a well drop is released to launch a wiper plug from a cementing head at the top joint of casing. In another example, in certain instances of multi-stage cementing, a well drop is released to plug a port collar shifting tool, prior to cementing through the open port collar. Well drops are used in many other contexts, including well treatment, fracing, well clean out and other operations.

DESCRIPTION OF THE DRAWINGS

Like reference symbols in the various drawings indicate like elements.

DETAILED DESCRIPTION

The concepts herein relate to releasing a well drop into an interior of a well tubing. A well drop releasing device mounts to a sidewall of the well tubing. The well drop releasing device is operated by control fluid pressure to linearly translate a well drop receptacle between a holding position, where a well drop in the receptacle is held in the well drop releasing device, and a releasing position, where the well drop is released from the receptacle into a center bore of the well tubing. The well drop releasing device has provisions for manual override by linearly pulling a manual override arm. The manual override arm also provides a visual indication of the position, holding or releasing, of the well drop receptacle. The configuration of the well drop device allows a well drop to be released into the interior of the tubing without stopping pumping or without release of pressure from the interior of the tubing.

Figure 1:
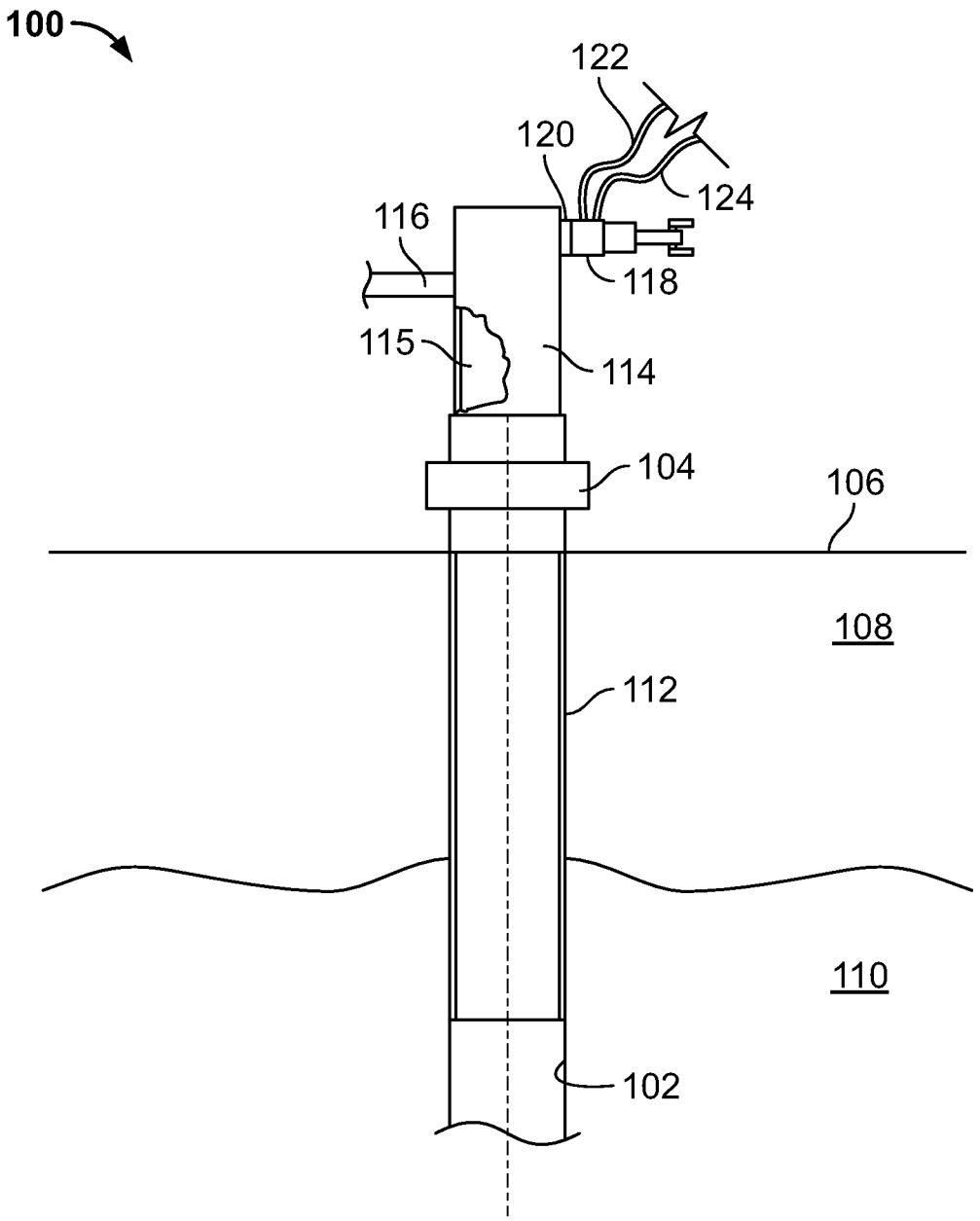
FIG. 1 is a side schematic view of a well site with a well drop releasing device installed on a top joint of a well tubing string.

Referring first to FIG. 1, a well system 100 is shown having a wellbore 102 that extends from a wellhead 104 at the surface 106 into the Earth 108 and through one or more subterranean zones 110. The wellbore 102 is lined, at least partially, with a tubing called casing 112. FIG. 1 shows an operation known as cementing, where cement is pumped through the center bore of the casing 112 to the bottom of the wellbore 102 and caused to circulate back up through the annulus between the casing 112 and the wall of the wellbore 102. The cement is allowed to cure to secure the casing 112 in the wellbore 102. In the cementing context, a well tubing called a cementing head 114 is attached to the topmost joint of casing 112, outside of the wellhead 104. The cementing head 114 has cement inlet 116 coupled to a source of cement (not shown). The cementing head 114 has a well drop releasing device 118 coupled thereto that extends laterally outward from the sidewall of the cementing head 114. In particular, the cementing head 114 has a bung 120 on a sidewall that encircles a side bore into the interior center bore 115 of the cementing head 114. The well drop releasing device 118 includes a coupling that mates and seals with the bung 120.

The well drop releasing device 118 includes first and second control lines 122, 124 coupled to different locations on the sidewall of the well drop releasing device 118. The control lines 122, 124 couple a control fluid pressure source to the well drop releasing device 118, to selectively supply control fluid (liquid or gas) to different aspects of the well drop releasing device 118. In certain instances, control fluid supplied to the first control line 122 causes the well drop releasing device 118 to change from a holding position where it internally holds a well drop to a releasing position where it moves the well drop into the center bore of the cementing head 114 and releases the well drop into the center bore. Control fluid supplied to the second control line 124 causes the well drop releasing device 118 to change from a releasing position back to a holding position, and can be used to maintain the well drop releasing device 118 in the holding position prior to moving to the releasing position. Notably, the well drop can be released into the center bore of the well tubing without removing pressure or flow from the tubing.

Although discussed herein in connection with a cementing operation and a cementing head, the well drop releasing device 118 can be used in many other contexts. Therefore, the well drop releasing device 118 can be couple to other types of well tubulars that extend outward from the well.

Figure 2:
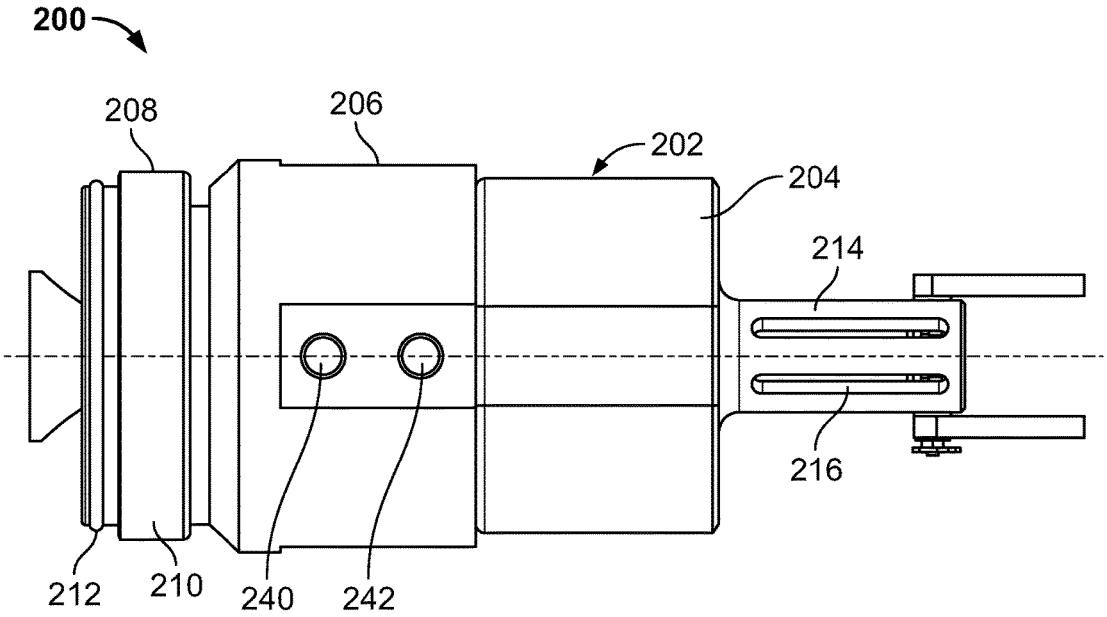
FIG. 2 is a side view of an example well drop releasing device.

FIG. 2 is an exterior side view of an example well drop releasing device 200 that can be used as the well drop releasing device 200 of FIG. 1. The well drop releasing device 200 has a generally cylindrical outer housing assembly 202 formed in two parts, a cap coupled (threadingly and/or otherwise) to an end of a main body 206. The main body 206 includes a coupling 208 that sealingly couples to the sidewall bung of well tubing (e.g. cementing head 114). As shown, the coupling 208 includes a threaded portion 210 configured to mate with threads of the bung (e.g., bung 120) and a seal 212 configured to seal against a seal surface of a bung. Other types of couplings can be used. The cap includes an elongate nose that receives a manual override arm 216.

Figure 3:
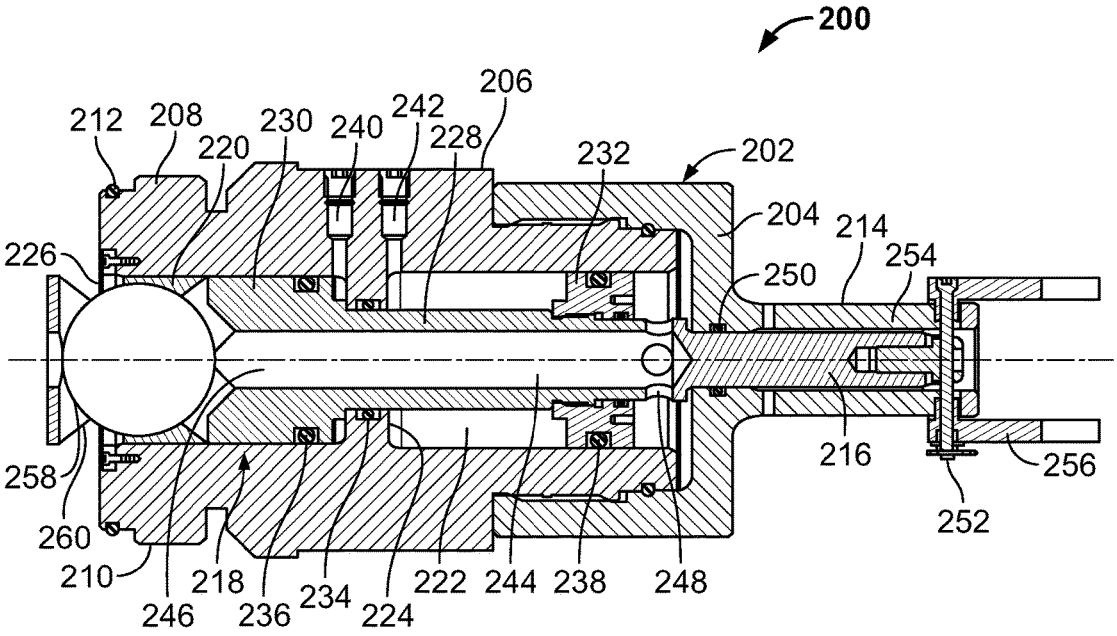
FIG. 3 is a half cross-sectional view of the example well drop releasing device of FIG. 2.

FIG. 3 is a half side cross-sectional view of the example well drop releasing device 200 of FIG. 2. The housing assembly internally receives and carries a well drop carrying assembly 218 to move linearly in the housing assembly. The main body 206 of the housing assembly is generally cylindrical and defines two generally cylindrical interior cavities 220, 222 separated by an annular wall 224. The first cavity 220 is near an end of the housing assembly and has an open end 226 that, when the well drop releasing device 200 is attached to a well tubing, is open to the central bore of the well tubing. The second cavity 222 is opposite the annular wall 224 from the first cavity and is enclosed by the cap 204.

The well drop carrying assembly 218 includes a central shaft 228 that extends through the center of the cavities, and carries a first piston 230 in the first cavity 220 and a second piston 232 in the second cavity 222. The annular wall 224 is sealed to the central shaft 228 with a seal 234. The first piston 230 includes a circumferential seal 236 that seals the first piston 230 to an inner wall of the first cavity 220, and the second piston 232 includes a circumferential seal 238 that seals the second piston 232 to the inner wall of the second cavity 222. The main body 206 has a first control fluid port 240 through a sidewall and into the first cavity 220, near an end of the first cavity 220 opposite the open end 226 and between the first piston 230 and the annular wall 224. The main body 206 has a second fluid control port 242 through a sidewall and into the second cavity 222 near an end of the second cavity 222 and between the second piston 232 and the annular wall 224. The first and second fluid control ports 240, 242 connect to control lines, such as the first and second control lines in FIG. 1, so that the control lines can selectively supply control fluid pressure into the first cavity 220 or the second cavity 222. Applying control fluid pressure into the first cavity 220 via the first control fluid port 240 applies pressure to the first piston 230 to drive the well drop carrying assembly 218 toward and out of the open end 226 of the first cavity 220, i.e., toward the well tubing. When the well drop carrying assembly 218 is at its full extent in this direction, it is in a releasing position (discussed in more detail below). Similarly, applying control fluid pressure into the second cavity 222 via the second control fluid port 242 applies pressure to the second piston 232 to drive the well drop carrying assembly 218 away from the open end 226 of the first cavity 220, i.e., away from the well tubing. When the well drop carrying assembly 218 is at its full extent in this direction, it is in a holding position (discussed in more detail below) and the well drop carrying assembly 218 is wholly out of the center bore of the well tubing.

The central shaft 228 of the well drop carrying assembly 218 has an internal passage 244 that communicates fluid from within the center bore of the well tubing to the second cavity 222 to pressure balance the well drop carrying assembly 218 to fluid pressure in the well tubing. To this end, the internal passage 244 has a first end 246 to an interior of the well tubing when the well drop releasing device 200 is coupled to the well tubing. The internal passage 244 has a second end 248 open to the second cavity 222 opposite the well tubing from the second piston 232, and thus to the volume in the second cavity 222 between the second piston 232 and the end of the second cavity 222 defined by the cap 204. The hydraulic area of the first piston 230 acted upon by fluids in the center bore of the well tubing is equal to the hydraulic area of the second piston 232 acted upon by fluids from the central bore of the well tubing communicated to the second cavity 222; and therefore, the forces from the pressure of fluids in the center bore of the well tubing acting on the first and second piston 232 are balanced. In certain instances, the well drop carrying assembly 218 is not biased one way or the other by pressure in the center bore of the well tubing. However, in other instances, the well drop carrying assembly 218 could be biased by making the hydraulic areas unequal.

The cap 204 includes a tubular extension 214 that internally receives and guides a manual override arm 216 portion of the well drop assembly central shaft 228. The extension 214 and shaft 228 are sealed by a seal 250. The manual override arm 216 and extension 214 are keyed to prevent the well drop carrying assembly 218 from rotating in the housing assembly, yet allow the well drop carrying assembly 218 to translate between the holding and releasing positions. FIG. 3 shows a bolt 252 through an end of the shaft 228 that extends through and rides in corresponding slots 254 in the sidewalls of the extension 214. The bolt 252 can additionally hold an eye or other grip 256 to the end of the manual override arm 216 outside of the housing assembly. The grip 256 enables a user to manipulate the manual override arm 216 to translate the well drop carrying assembly 218 between the releasing and holding positions. The grip 256 and manual override arm 216 enable, for example, the well drop releasing device 200 to be operated without control pressure if one or both of the control lines fail. In addition to facilitating manual override, the grip indicates the position of the well drop carrying assembly 218 as being in the holding or the releasing position. When the grip is adjacent the body of the cap 204, the well drop carrying assembly 218 is in the releasing position. When the grip is at its full extent apart from the body of the cap 204, the well drop carrying assembly 218 is in the holding position.

An end of the well drop carrying assembly 218 proximate the first cavity 220 includes a well drop receptacle 258 sized to receive and hold a well drop 262. The well drop receptacle 258 has a drop opening 260 that the well drop can freely pass through. In certain instances, the drop opening 260 is a cylindrical through hole through the well drop receptacle 258. FIG. 3 shows the receptacle 258 sized to accommodate a spherical ball shaped well drop 262; however, in other instances the well drop 262 can take other forms, including a dart shape, a cylinder or other shape. When well drop carrying assembly 218 is in the holding position (FIG. 3), the well drop receptacle 258 and the drop opening 260 are wholly within the first cavity 220 and out of the central bore of the well tubing. The drop opening 260 of the well drop receptacle 258 is blocked by the sidewall of the first cavity 220 to retain any well drop in the well drop receptacle 258. When the well drop carrying assembly 218 is in the release position, the well receptacle 258 is outward, apart from the housing, in the center bore of the well tubing, and the drop opening 260 of the well drop receptacle 258 is open, not blocked by the housing, to release any well drop in the well drop receptacle 258 into the center bore of the well tubing. The outer surface of the well drop carrying assembly 218 about the well drop receptacle 258 is cylindrical and sized to closely pass through the open end 226 of the first cavity 220, so that the housing assembly guides it. Additionally the outer surface of the well drop carrying assembly 218 can be keyed to the housing assembly in the vicinity of the well drop receptacle 258 to prevent rotation of the well drop carrying assembly 218.

In operation, the well drop releasing device 200 is coupled to a sidewall bung of a well tubing, e.g. the cementing head 114. Fluid can be pumped and other operations performed through the well tubing with the well drop releasing device 200 in place. Pressure can be applied through the second control port 242 to maintain the well drop carrying assembly 218 in the holding position, with the well drop receptacle 258 in the first cavity 220. When it is desired to release a well drop 260 into the well tubing, fluid pressure is applied through the second control port 242 to move the well drop carrying assembly 218 into the releasing position. In the releasing position, the well drop receptacle 258 is in the center bore of the well tubing and the well drop receptacle 258 is open and unobstructed. The well drop 260 is released from the well drop receptacle 258 and into the center bore of the well tubing. The pumping need not be ceased, nor pressure within the center bore released, while the well drop receptacle 258 is moved to the releasing position. Thereafter, fluid pressure is applied through the second control port 242 to move the well drop receptacle 258 back to the holding position. If, at any point, fluid pressure cannot be applied to the first or second control ports 240, 242, the manual override arm 216 can be manipulated by a person. Since the well drop carrying assembly 218 is pressure balanced to the pressure in the center bore, the person operating the manual override arm 216 need not overcome the pressure differential between the center bore and the surrounding atmosphere.

Thus, the concepts encompass a well drop releasing device having a housing defining an interior cavity. The device includes coupling that is sealingly couplable to a well tubing on a sidewall of the well tubing. The well drop has a piston in the cavity sealed to a cavity wall. The piston moves linearly in response to a control fluid pressure in the cavity. The well drop receptacle is provided to receive a well drop. The well drop receptacle is moved with the piston between a holding position, with the well drop receptacle arranged to hold a well drop in the well drop receptacle, and a releasing position, with the well drop receptacle arranged to release a well drop from the well drop receptacle into the well tubing.

The concepts encompass a method where a well drop is held in a receptacle of a well drop releasing device, apart from an interior of a well tubing. In response to a control fluid pressure on a piston, the receptacle is linearly translated to release the well drop into the interior of the well tubing.

The concepts encompass a device having a housing attachable to a well tubing. The device has a well drop carrier to carry a well drop. The well drop carrier is linearly movable to move the well drop from an exterior the well tubing into an interior the well tubing and release the well drop in the interior of the well tubing.

The concepts above include some, none or all of the following features. The well drop receptacle, in certain instances, is cylindrical to receive a spherical ball well drop. The holding position is with a drop opening of the well drop receptacle residing blocked by the housing. The releasing position is with the drop opening of the well receptacle apart from the housing and open to release a well drop from the well drop receptacle. The piston moves the well drop receptacle from the holding position to the releasing position in response to fluid pressure in the cavity. The housing defines a second cavity sealed from the first mentioned cavity, and the well drop releasing device includes a second piston in the second cavity sealed to a wall of the second cavity. The second piston is coupled to the well drop receptacle to move the well drop receptacle from the releasing position to the holding position in response to fluid pressure in the second cavity. The first mentioned piston and the second piston are pressure balanced to fluid pressure in the well tubing when the well drop releasing device is coupled to the well tubing. A fluid passage of the well drop releasing device has an open end to an interior of the well tubing when the well drop releasing device is coupled to the well tubing, and an open end to the second cavity on a side of the second piston opposite the well tubing. An end of the first mentioned cavity is open to an interior the well tubing when the well drop is releasing device is coupled to the well tubing. The well drop releasing device includes a first fluid line port to the first mentioned cavity and a second fluid line port to the second cavity. The housing and piston are keyed to prevent the piston from rotating in the housing. A manual override arm is coupled to the piston to move with the piston, and is sealed to the housing and protruding from the first mentioned cavity. The manual override arm provides a visual indication viewable from outside of the well drop releasing device of the well drop receptacle position.

A number of embodiments have been described. Nevertheless, it will be understood that various modifications may be made. Accordingly, other embodiments are within the scope of the following claims

We claim:

1. A well drop releasing device, comprising:

a housing defining a first cavity and a second cavity, and comprising a coupling, sealingly couplable to a well tubing on a sidewall thereof;

a first piston in the first cavity sealed to a cavity wall of the first cavity to move linearly in response to a first control fluid pressure in the first cavity;

a second piston in the second cavity sealed to a cavity wall of the second cavity to move linearly in response to a second control fluid pressure in the second cavity; and a well drop receptacle operable to receive a well drop and coupled to the first and second pistons, wherein the first and second pistons move, based on the first and second control pressures to the first and second cavities, the well drop receptacle between a holding position, where the well drop receptacle is within the first cavity to hold a well drop in the well drop receptacle, and a releasing position, where the well drop receptacle is in a center bore of the well tubing to release a well drop from the well drop receptacle into the well tubing.

2. The well drop releasing device of claim 1, wherein the well drop receptacle is cylindrical to receive a spherical ball.

3. The well drop releasing device of claim 1, wherein for the holding position, a drop opening of the well drop receptacle is blocked by the housing and for the release position, the drop opening of the well drop receptacle is apart from the housing and open to release the well drop from the well drop receptacle.

4. The well drop releasing device of claim 1, wherein the first and second pistons move the well drop receptacle from the holding position to the releasing position in response to the control fluid pressures in the first and second cavities;

wherein the second cavity is sealed from the first cavity; and wherein the second piston in the second cavity moves the well drop receptacle from the releasing position to the holding position in response to the control fluid pressure in the second cavity.

5. The well drop releasing device of claim 4, wherein the first piston and the second piston are pressure balanced to fluid pressure in the well tubing when the well drop releasing device is coupled to the well tubing.

6. The well drop releasing device of claim 4, comprising a fluid passage having a first end open to an interior of the well tubing and a second end open to the second cavity on a side of the second piston opposite the well tubing when the well drop releasing device is coupled to the well tubing; and wherein an end of the first cavity is open to the interior of the well tubing when the well drop releasing device is coupled to the well tubing.

7. The well drop releasing device of claim 4, comprising a first fluid line port connected to the first cavity and a second fluid line port connected to the second cavity.

8. The well drop releasing device of claim 1, wherein the housing and the pistons are keyed to prevent the pistons from rotating.

9. The well drop releasing device of claim 4, comprising a manual override arm coupled to the pistons to move with the pistons, sealed to the housing and protruding from the second cavity.

10. The well drop releasing device of claim 9, wherein the manual override arm provides a visual indication viewable from outside of the well drop releasing device of a position that the well drop receptacle is in.

11. The well drop releasing device of claim 1, wherein the coupling is sealingly couplable to a bung on the sidewall of the well tubing.

12. A method, comprising:

holding a well drop in a receptacle of a well drop releasing device in a housing, apart from an interior of a well tubing, the housing defining first and second cavities with a first piston in the first cavity and a second piston in the second cavity; and in response to first and second control fluid pressures on the first and second pistons, linearly translating the receptacle between a holding position, where the receptacle is within the first cavity to hold the well drop in the receptacle, and a releasing position, where the receptacle is in the interior of the well tubing to release the well drop into the interior of the well tubing.

13. The method of claim 12, wherein the well drop is a spherical ball.

14. The method of claim 12, comprising, in response to the second control fluid pressure on a first surface of the second piston, linearly translating the receptacle out of the interior of the well tubing.

15. The method of claim 12, comprising communicating fluid pressure from the interior of the well tubing to a surface of the second piston adjacent a cap of the well drop releasing device while communicating the fluid pressure from the interior of the well tubing to a surface of the first piston opposite the surface of the second piston.

16. The method of claim 12, wherein said linearly translating the receptacle comprises linearly translating the receptacle to release the well drop into the interior of the well tubing while a pressure in the well tubing is higher than atmospheric.

17. The method of claim 12, wherein said linearly translating the receptacle comprises linearly translating the receptacle to release the well drop into the interior of the well tubing while fluid is flowing through the well tubing.

18. A device, comprising:

a housing attachable to a well tubing and defining a first cavity and a second cavity with a first piston in the first cavity and a second piston in the second cavity; and a well drop carrier to carry a well drop, the well drop carrier being configured to linearly move, based on first and second control pressures applied to the first and second cavities, from the first cavity into a center bore of the well tubing to release the well drop into the center bore of the well tubing.

19. The device of claim 18, wherein the pistons are moveable in response to the first and second control pressures.

20. The device of claim 18, wherein the pistons are pressure balanced to a pressure in the well tubing via a fluid passage that communicates fluid from the center bore of the well tubing to the second cavity.

* * * * *